United States Patent [19]

Calhoun

[11] Patent Number: 4,685,647

[45] Date of Patent: Aug. 11, 1987

[54] MAGNIFYING READING STAND

[76] Inventor: Myrtle M. Calhoun, 9821 82nd Ave. E., Puyallup, Wash. 98373

[21] Appl. No.: 876,445

[22] Filed: Jun. 20, 1986

[51] Int. Cl.[4] ..... A47B 97/04

[52] U.S. Cl. ..... 248/444.1; 248/473

[58] Field of Search ..... 248/444.1, 441.1, 450, 248/453, 458, 473, 442.2; 211/40, 41; 281/45, 46

[56] References Cited

U.S. PATENT DOCUMENTS

| | | | |
|---|---|---|---|
| 476,807 | 6/1892 | Mortimer | 248/458 |
| 664,031 | 12/1900 | Albright | 248/458 |
| 1,947,757 | 2/1934 | Clark | 248/453 |
| 2,505,615 | 4/1950 | Glass | 248/441.1 |
| 3,272,183 | 9/1966 | Craighead | 248/453 |
| 3,361,131 | 1/1968 | Barger | 248/473 X |
| 3,874,501 | 4/1975 | Cronheim | 248/453 X |
| 4,163,497 | 8/1979 | McEwen | 248/441.1 X |
| 4,238,101 | 12/1980 | Kaye | 248/441.1 |
| 4,496,127 | 1/1985 | Nelson | 248/441.1 |
| 4,552,382 | 11/1985 | Cowden | 281/45 |

*Primary Examiner*—J. Franklin Foss

*Attorney, Agent, or Firm*—Quaintance, Murphy & Presta

[57] ABSTRACT

A reading stand or holder including a base with a transversely slotted upper surface, a rear, flat background plate in one of the slots for supporting material, such as a book, in an upright, open position, a placement bar in a slot in front of the open book for maintaining open the pages of the open book, and a transparent, flat magnifying panel in one of a number of grooves in front of the open book for magnifying the matter to be read. The further the magnifying panel is from the open book, the greater the degree of magnification. The magnifier stand is particularly useful for following a recipe in a cookbook while cooking. The stand may be seated on a wedge block to tilt the stand or mounted on a swivel, lazy Susan base, to facilitate reading the material. Another, smaller version of the magnifier stand may be used within or on top of a conventional index card box, for reading the cards. The magnifier stand greatly assists in hands-off following of small print instructions while engaged in almost any form of endeavor, craft or hobby, e.g., cooking, sewing, crocheting, model building, constructing electronic kits or components and so forth.

15 Claims, 6 Drawing Figures

MAGNIFYING READING STAND

BACKGROUND OF THE INVENTION

This invention relates to reading stands in general and, more particularly, to a reading stand for supporting an open book or an index card having instructions or the like printed thereon so that the user may proceed with an endeavor, craft or hobby and follow the printed instructions in a hands-off manner.

The instant invention provides such a stand which includes a transparent, flat magnifying panel which is placed in front of the printed material so that the user may follow the instructions or directions by reading the same from a rather considerable distance.

The following prior art includes a number of useful reading stands but none which disclose the use of a magnifying panel so that the material being read is enlarged whereby the user may follow instructions or the like from a considerable reading distance. U.S. Pat. No. 2,896,364 issued to H. M. McCollister shows a bed headboard attached book holder including a transparent panel through which the book may be read. The panel may be made of plastic or glass but the panel has no magnifying function. U.S. Pat. No. 3,272,183 issued to M. E. Craighead et al discloses a stand for stenographic papers including multiple slots for a supporting back for holding copy and additional backs for holding papers not being copied; no transparent panel through which copy is read is disclosed.

U.S. Pat. No. 3,874,501 issued to R. B. Cronheim is directed to an index card box including an opaque plate with clips for the display of the preselected card. No transparent viewing a panel is disclosed. U.S. Pat. No. 4,199,125 issued to K. Simon illustrates a bathtub edge supported reading stand including a transparent shield over a stand which retains the copy being read. However, the shield has no magnification characteristic. U.S. Pat. No. 4,313,589 issued to A. S. Vega shows a bookstand for bed use including a transparent base through which an open book is read while the user is in a reclined position. Again, however, there is no teaching that the transparent base has any magnification function.

In direct contradistinction to the prior art, the present invention is a reading stand or holder having a base to support copy and a transparent, flat magnifying panel which is placed a pre-selected distance from the copy being read whereby the copy is magnified so that it may be read from a considerable distance away. The reading stand of this invention may also be mounted on or within an otherwise conventional file card box so that a selected card may be placed behind the magnifying panel and then be read from some distance away.

SUMMARY OF THE INVENTION

Accordingly, it is a principal object of the invention to provide a reading stand including a base for supporting material to be read and a transparent, flat magnifying panel mounted on the base a pre-selected distance away from the material to be read whereby printed information is greatly magnified and thus may be read a considerable distance away from the reading stand.

It is another object of the invention to provide a combination of reading stand and file card box, the reading stand including a base mounted either on top of the lid of the box or within the box, the base including a support for a file card or the like and a transparent, flat magnifying panel placed a pre-selected distance away from the file card so that information on the card may be read from a considerable distance away.

It is a further object of the invention to provide a reading stand or holder including a base with adjustable components for retaining an open book thereon and a flat, transparent magnifying panel which may be placed in front of the material to be read so that information is magnified.

Yet another object of the invention is to provide a reading stand or holder including a base for supporting material to be read and a magnifying panel for enlarging the information to be read, the base including a support for inclining the base so as to facilitate reading of material.

It is yet a further object of the invention to provide a reading stand or holder including a base for supporting material to be read and a magnifying panel in front of the material so as to enlarge the information being read, the base being mounted on a lazy Susan type support stand whereby the base may be rotated to facilitate reading the information held by the reading stand.

Further and more complete objects and advantages of the invention will become readily apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which:

FIG. 1 is a perspective view of one embodiment of the invention which is particularly useful for holding an open book or the like;

DESCRIPTION OF THE PREFERRED EMBODIMENTS

Figure 1:
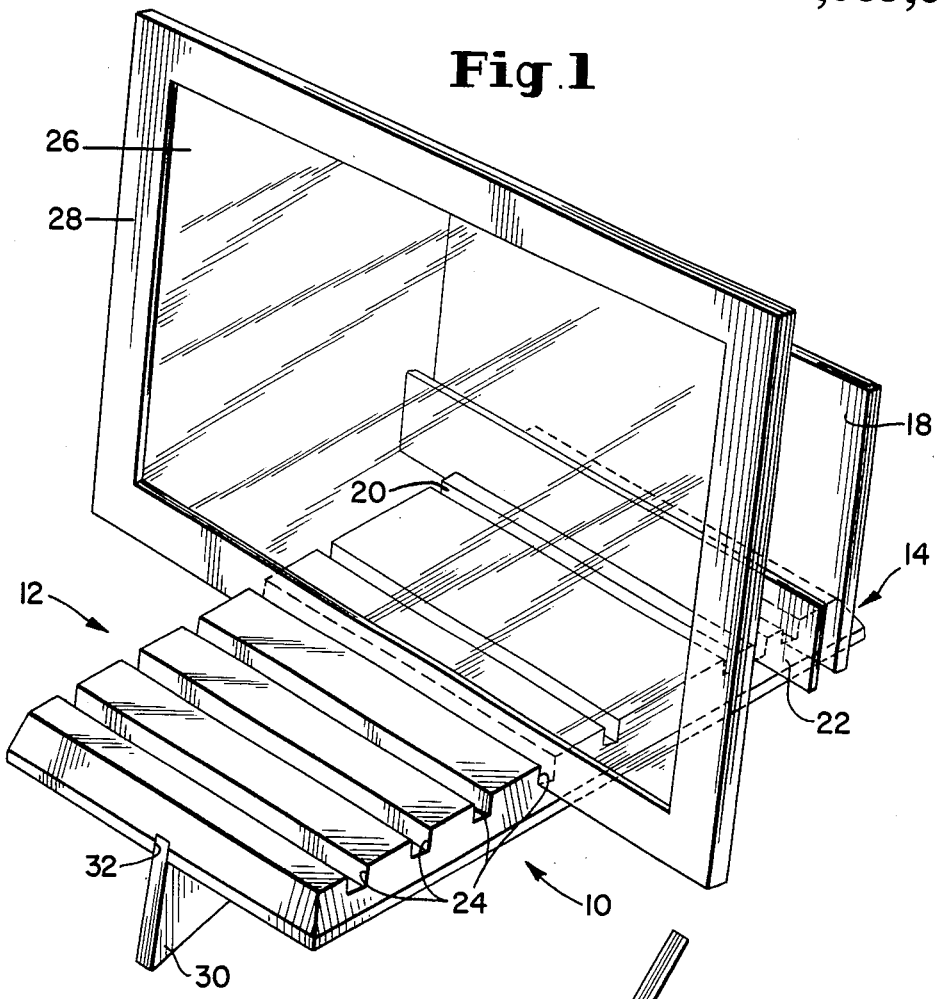
Figure 2:
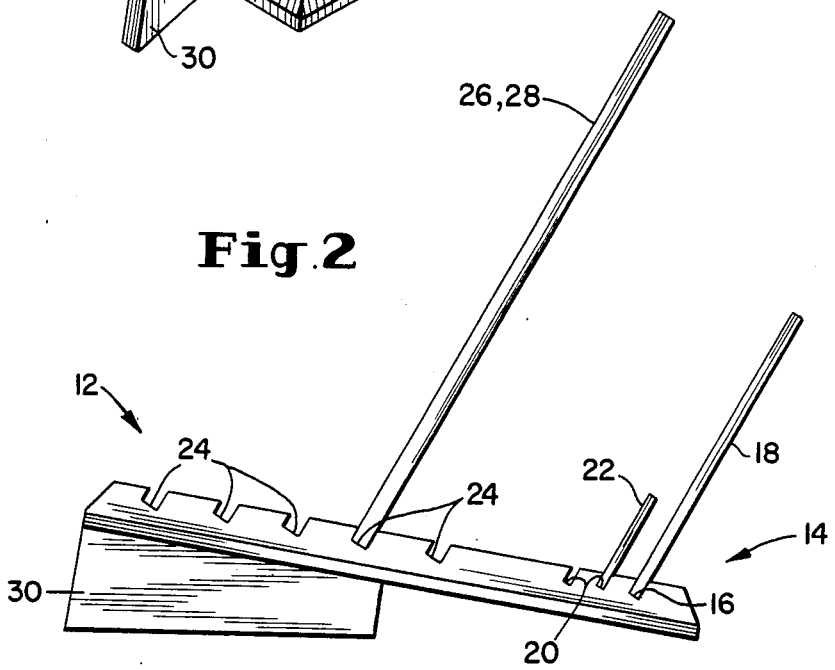
FIG. 2 is a side elevation view of the embodiment of the invention as shown in FIG. 1.

Referring now to the drawings by reference character, an embodiment of the invention is shown in FIG. 1 including a base 10 having an upper surface generally divided into a front portion 12 and a rear portion 14. As best seen in FIG. 2, rear portion 12 includes a first transverse slot 16 extending across the rear portion 14 of base 10. A support or background plate 18 is removably mounted within first transverse slot 16. Background plate 18 serves to support an open book or the like. A pair of second transverse slots 20,20 are formed in rear portion 14 of base 10 forwardly of first transverse slot 16. A placement bar 22 is selectively placed in one of the second transverse slots 20,20 so that, in conjunction with backgound plate 18, an open book or the like is retained between these members.

The front portion 12 of base 10 includes a plurality of grooves 24 formed in the base upper surface front portion and extending transversely thereacross, generally parallel one another and also being parallel with the slot 16, 20 and 20 and the backgound plate 18 and a placement bar 22. A transparent, flat magnifying panel 26 having a peripheral supporting frame 28 is selectively received in one of the transverse grooves 24 which, in this embodiment of the invention, are five in number as is illustrated in FIG. 1. Thus, it is readily apparent that an open book or the like (which might be a cookbook with recipes) can be placed in between backgound plate 18 and placement bar 22 and then read through the transparent magnifying panel 26. It can be further appreciated that the panel 26 has rather substantial dimensions so as to encompass and extend beyond the edges of the material being read.

As the panel 26 is moved away from backgound plate 18 and the material being supported therein, the magnification effect is, obviously, greater. In any event, the user may simply select one of the slots 24 for the desired magnifying effect. Thus, while cooking, the user can place a cookbook in the reading stand and have the same located a considerable distance away so that information, such as a recipe, may be clearly read and followed without having to touch the book. Furthermore, the stand and book may be separated a considerable distance from the cooking area so as to minimize any chance of soiling the cook book.

Of course, using the invention for cooking is only one example of a wide variety of activities with which the invention might be used. For example, the stand may be used to support an open book or card containing instructions which can be followed while engaged in almost any form of endeavor, craft or hobby, such as cooking, sewing, crocheting, model building, constructing electronic kits or components and so forth.

To further facilitate ease of reading, the base might be provided with a wedge block or the like 30, mounted on the undersurface of base 10 as is clearly shown in FIG. 2 so that the base 10 is tilted when placed on the horizontal supporting surface. As seen in FIG. 1, wedge 30 can be frictionally received within a slot 32 formed centrally within the undersurface of base 10.

Figure 5:
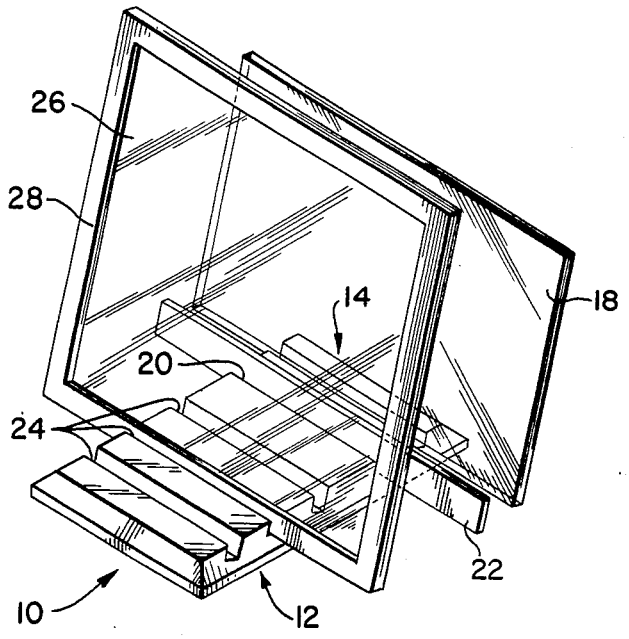
FIG. 5 is a perspective view of a smaller embodiment of the invention than is shown in FIG. 1.

A smaller version of this embodiment of the invention is illustrated in FIG. 5 wherein the number of grooves 24 for supporting magnifying panel 26 are but three in number. This smaller embodiment of the invention might be used to support smaller books, pamphlets or file cards such as index cards.

Figure 6:
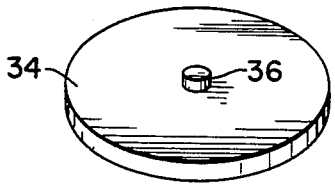
FIG. 6 is a perspective view showing a swivel base or lazy Susan type base which may be used with the embodiments of the invention as shown in FIGS. 1 and 5.

Either of the embodiments shown in FIG. 1 or 5 might be supported by the wedge 30 so that base 10 is inclined. An alternate form or support could be a swivel base or rotatable support such as a lazy Susan 34 as is illustrated in FIG. 6. Of course, the details of construction of rotatable support 34 per se form no part of the instant invention. The support 34 includes a central, upperwardly extending peg 36 upon which base 10 may be mounted.

Figure 3:
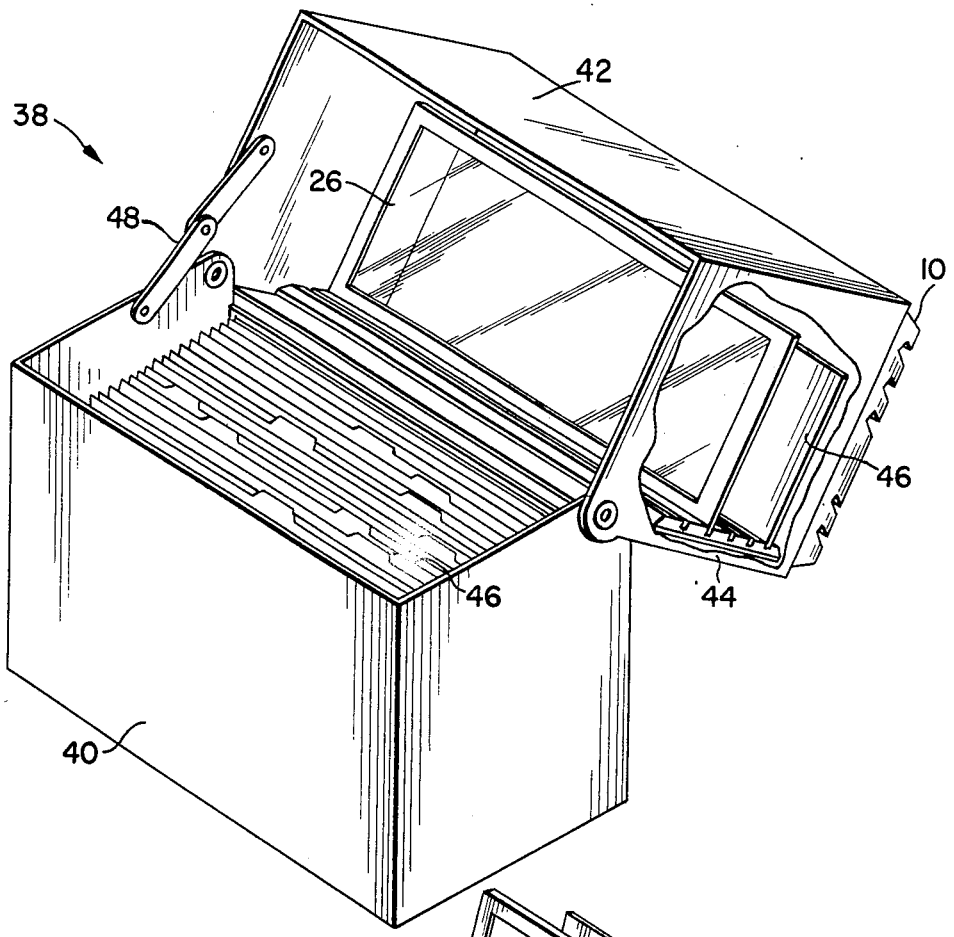
FIG. 3 is a perspective view of another embodiment of the invention, showing the invention mounted in an otherwise conventional file card box.
Figure 4:
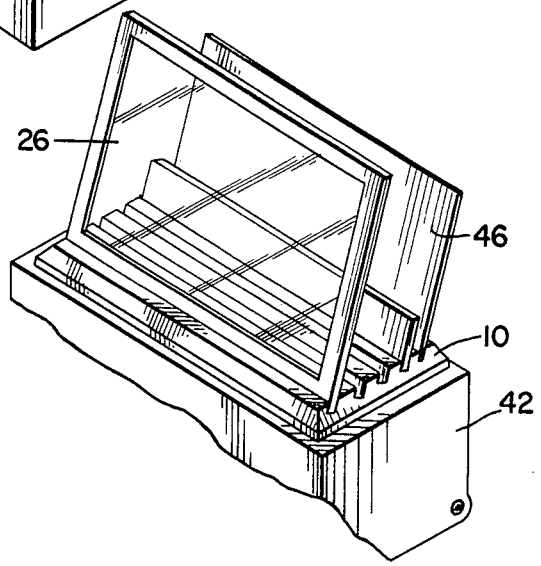
FIG. 4 is a partial perspective view of the embodiment of the invention as shown in FIG. 3 showing the top of the lid of the file card box.

Turning now to FIGS. 3 and 4, a second embodiment of the invention is illustrated which includes, in combination, an otherwise conventional file card box 38 having a bottom card container 40 and a top, pivoting lid 42. As shown in FIG. 3, container 40 may include a collection of index cards 44 having printed matter, such as recipes, thereon. By way of example, container 40 might include a collection of three by five index cards. A base 10 may be mounted on the top of the lid 42 of file card box 38 as is shown in FIG. 34. Background plate 18 and placement bar 22 are positioned so that a file card may be inserted therebetween. The flat magnifying panel 26 is mounted in one of the grooves 24 so that the information on the index card is greatly magnified. After use, of course, the index card may simply be replaced within container 40.

As shown in FIG. 3, an additional base 10 and flat magnifying plate 26 may be mounted within the lid 42, on the rear lateral wall 44 of lid 42. Thus an index card 46 may be selected and placed as shown in FIG. 3 whereafter the magnifying panel 26 may be positioned in front of the index card 46. After use, the panel 26 may be moved so as to access the card 46 and replace it within the container 40.

In this embodiment of the invention, both the background plate 18 and the placement bar 22 are not necessary; thus, the index card 46 could simply be placed within a rear slot 16.

The file card box 38 might include a lid hinge assembly 48 for maintaining lid 42 in a rearwardly tilted position as is illustrated in FIG. 3 so as to further facilitate reading of an index card 46 mounted on base 10 which is on the rear lateral wall 44 of the lid 42.

The invention may be embodied in other specific forms without departing from the spirit or essental characteristics thereof. The present embodiments are therefore to be considered in all respects as illustrative and not restrictive, the scope of the invention being indicated by the appended claims rather than by the foregoing description and all changes that come within the meaning and range of equivalency of the claims are therefore intended to be embraced therein.

I claim:

1. A magnifying reading stand assembly comprising: base means for supporting reading matter in a generally upright, stable attitude; and transparent panel magnifying means arranged for placement in front of the reading matter a predetermined distance therefrom, there being means on said base means for supporting said transparent panel generally parallel with the reading matter, thus to facilitate viewing of the reading matter a considerable distance from said reading stand assembly; said base means including an upper surface having a front portion and a rear portion, the rear portion being arranged to support reading matter, said base means further comprising a plurality of transverse groove means formed within and across said base means front portion, generally parallel one another, for selective reception of said transparent panel magnifying means and for selective, variable magnification of the reading matter to suit the user, the degree of magnification being increased, the farther the transparent panel magnifying means is separated from the reading matter.

2. The magnifying reading stand assembly as claimed in claim 1 wherein said base means further comprise a first transverse slot means formed within and across the upper rear surface of said base means and a background plate means received in said first slot means for supporting reading matter thereon.

3. The magnifying reading stand assembly as claimed in claim 2, further comprising placement bar means and second transverse slot means formed within and across the upper rear surface of said base means, generally parallel with and in front of said first slot means, said placement bar being received within said second slot means such that reading matter in the form of an open book or the like may be positioned between said background plate means and said placement bar means.

4. The magnifying reading stand assembly as claimed in claim 3 wherein said second transverse slot means are at least two in number for selective placement of said placement bar means with respect to said background plate means.

5. The magnifying reading stand assembly as claimed in claim 3 wherein both said first and second transverse slot means are dimensioned with respect to said background plate and placement bar means such that said background plate and placement bar means are removably received with said first and second transverse slot means, respectively.

6. The magnifying reading stand assembly as claimed in claim 1 wherein said base means further comprise a first transverse slot means formed within and across the upper rear surface of said base means for supporting reading matter in the form of an index card or the like in an upright attitude within said first slot means.

7. The magnifying reading stand assembly as claimed in claim 1 wherein said base means further comprise wedge block means on the undersurface of said base means for supporting said base means in a tilted attitude on a generally horizontal surface, thus to facilitate the reading of matter placed on said stand.

8. The magnifying reading stand as claimed in claim 1 wherein said base means further comprise rotatable support means upon which said base means are mounted whereby said base means may be rotated to a desired position thus to facilitate the reading of matter placed on said stand.

9. The magnifying reading stand as claimed in claim 1 wherein said transverse groove means are five in number.

10. The magnifying reading stand as claimed in claim 1 further comprising, in combination, an otherwise conventional file card box including a container for file cards and a lid pivotally mounted on top of the container, said base means being affixed to the top of said file card box lid.

11. The magnifying reading stand as claimed in claim 10 wherein said combination further comprises a second base means, substantially identical to said first base means, affixed to an interior wall of said file card box lid.

12. A magnifying reading stand assembly comprising: base means for supporting reading matter in a generally upright, stable attitude said base means including an upper surface having a front portion and a rear portion; a first transverse slot means formed within and across said rear portion of said base means; a background plate received in said first slot means for supporting reading matter thereon; second transverse slot means formed within and across said base means rear portion, generally parallel with and in front of said first slot means; placement bar means, received within said second slot means such that reading matter is retained and supported between said placement bar and background plate means; said second slot means being at least two in number for adjustable positioning of said placement bar means; and a plurality of transverse groove means formed with and across said base means front portion, for receiving and retaining said transparent panel means therewithin in an upright attitude and generally parallel with said background plate means; said groove means being at least three in number, generally parallel one another, for selective reception of said transparent panel magnifying means and for selective, variable magnification of the reading matter to suit the user, the degree of magnification being increased, the farther the transparent panel magnifying means is separated from the reading matter.

13. The magnifying reading stand assembly as claimed in claim 12 wherein said transverse groove means are five in number.

14. The magnifying reading stand assembly as claimed in claim 12 wherein said base means further comprise wedge block means on the undersurface of said base means for supporting said base means in a tilted attitude on a generally horizontal surface, thus to facilitate the reading of matter placed on said stand.

15. The magnifying reading stand assembly as claimed in claim 12 wherein said transparent panel magnifying means are made of a plastics material and further comprise a peripheral, supporting frame.

* * * * *